United States Patent [19]

Fusi et al.

[11] Patent Number: 4,771,499

[45] Date of Patent: Sep. 20, 1988

[54] PAINT SPREADER APPARATUS FOR THE MAINTENANCE OF INSTALLED POLES, WITH PAINT EJECTOR AND SPREADING ROLLERS

[75] Inventors: Gaetano Fusi; Silvio Meniconi, both of Poggibonsi, Italy

[73] Assignee: SIVEP di Meniconi Giorgio e C. S.a.s., Siena, Italy

[21] Appl. No.: 34,061

[22] Filed: Apr. 2, 1987

Related U.S. Application Data

[62] Division of Ser. No. 749,288, Jun. 26, 1985, Pat. No. 4,677,935.

[30] Foreign Application Priority Data

Jun. 27, 1984 [IT] Italy ..... 9448 A/84

[51] Int. Cl.[4] ..... B08B 1/04

[52] U.S. Cl. ..... 15/88; 15/104.04; 118/72; 118/108; 118/DIG. 11

[58] Field of Search ..... 118/108, DIG. 11, 72; 15/88, 104.04

[56] References Cited

U.S. PATENT DOCUMENTS

| | | | |
|---|---|---|---|
| 2,301,165 | 11/1942 | Neal | 118/108 |
| 2,858,555 | 11/1958 | Medovick | 118/307 X |
| 2,998,801 | 9/1961 | Edelberg | 118/108 |
| 3,116,811 | 1/1964 | Stevenson | 118/208 X |

FOREIGN PATENT DOCUMENTS

| | | | |
|---|---|---|---|
| 6241 | of 1901 | United Kingdom | 118/72 |

*Primary Examiner*—Evan K. Lawrence

*Attorney, Agent, or Firm*—Hopgood, Calimafde, Kalil, Blaustein & Judlowe

[57] ABSTRACT

An apparatus for cleaning and spray painting pole structures. The apparatus includes a carriage constructed to be upwardly and downwardly movable along the axis of the pole to be cleaned or painted. Mounted on the carriage is a carousel rotatably secured so as to revolve around the pole as the carriage moves upwardly and downwardly. The carousel may be provided with brushes for cleaning the pole or with a paint sprayer for applying paint. In one embodiment two pairs of rollers are located symmetrically with respect to the sprayer and the poles so that the rollers evenly apply the paint to the pole and simultaneously minimize overspray losses.

4 Claims, 4 Drawing Sheets

Fig. 3
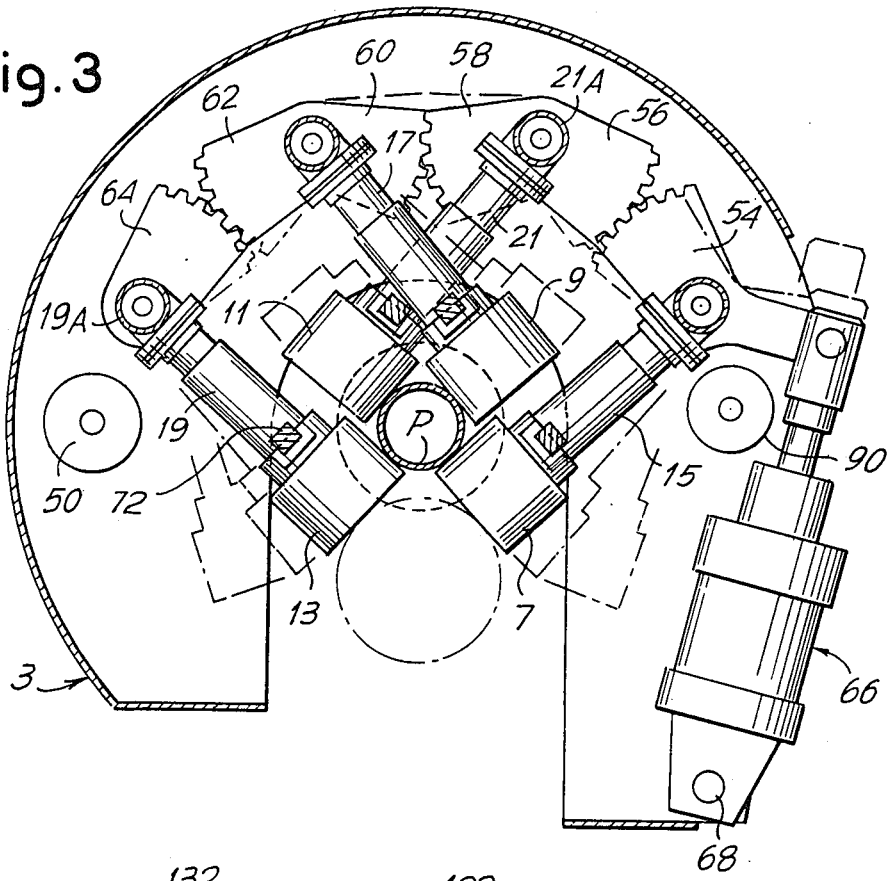
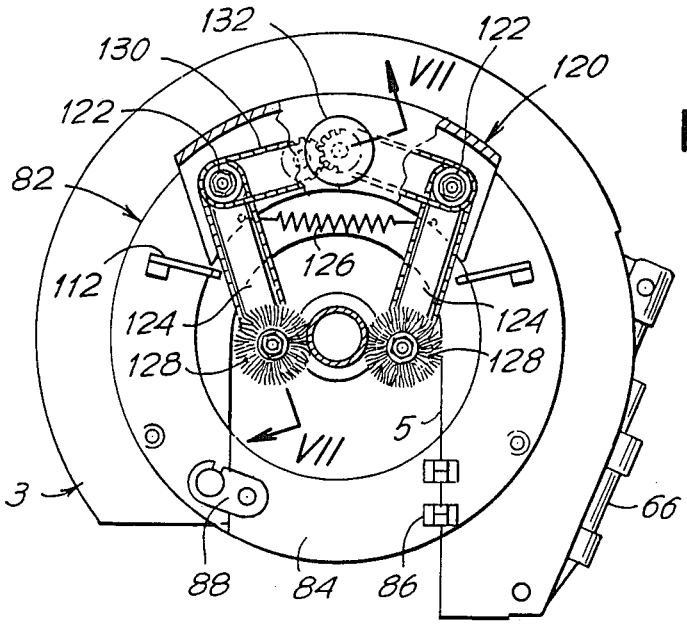
Fig. 6

Fig. 4
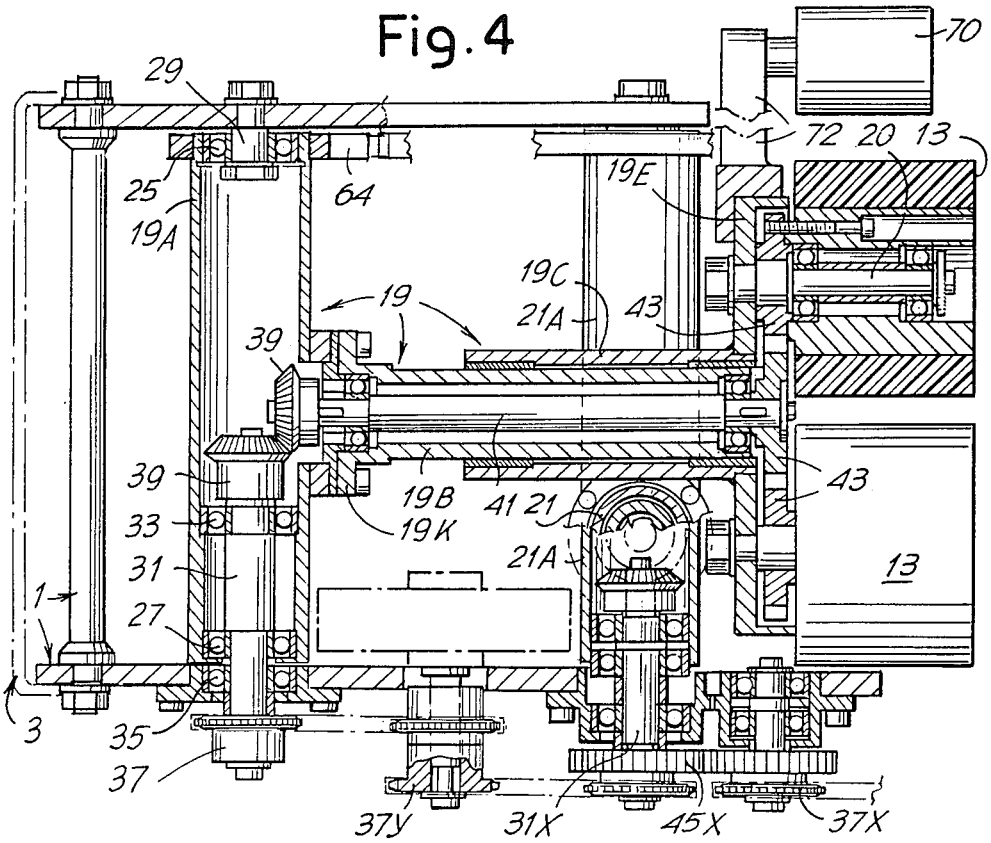
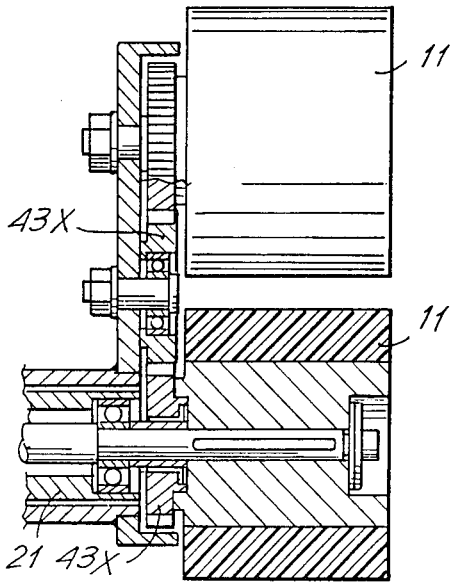
Fig. 5

PAINT SPREADER APPARATUS FOR THE MAINTENANCE OF INSTALLED POLES, WITH PAINT EJECTOR AND SPREADING ROLLERS

This is a divisional of co-pending application Ser. No. 749,288, filed on June 26, 1985, now U.S. Pat. No. 4,677,935.

TECHNICAL FIELD

The present invention relates to apparatus for maintaining pole structures.

SUMMARY AND OBJECT OF INVENTION

An object of the present invention is to provide an apparatus for spreading paint and otherwise maintaining pole structures. The inventive apparatus includes a carriage constructed to be moveable upwardly and downwardly along the axis of a pole and mounted on that carriage a carousel. The carousel is rotatably secured to the carriage structure so as to revolve around the pole as the carriage moves up and down. A paint spreader is located on the carousel for spreading paint on the circumference of the pole about a given height To this end, two pairs of rollers are symmetrically located with respect to a paint sprayer. The rollers are biased to engage the pole about its circumference and are operative to spread paint on the pole including overspray from the sprayer which is directly incident on the rollers. Instead of the paint sprayer, the carousel may be provided with brushes for cleaning the pole.

A BRIEF DESCRIPTION OF DRAWINGS

The invention will be described in detail below in connection with the accompanying drawings wherein like numerals designate similar parts.

In the drawings:

FIG. 3 is a schematic top view, in section, showing the rollers which drive the apparatus of FIG. 1 upwardly and downwardly along a pole;

FIG. 4 is a detail of the apparatus of FIG. 1 showing the drive mechanism for the rollers illustrated in FIG. 3;

FIG. 5 is a detail of the illustration of FIG. 4;

FIG. 6 illustrates the apparatus of FIG. 1, in top view, equipped with cleaning brushes;

DETAILED DESCRIPTION

Figure 1:
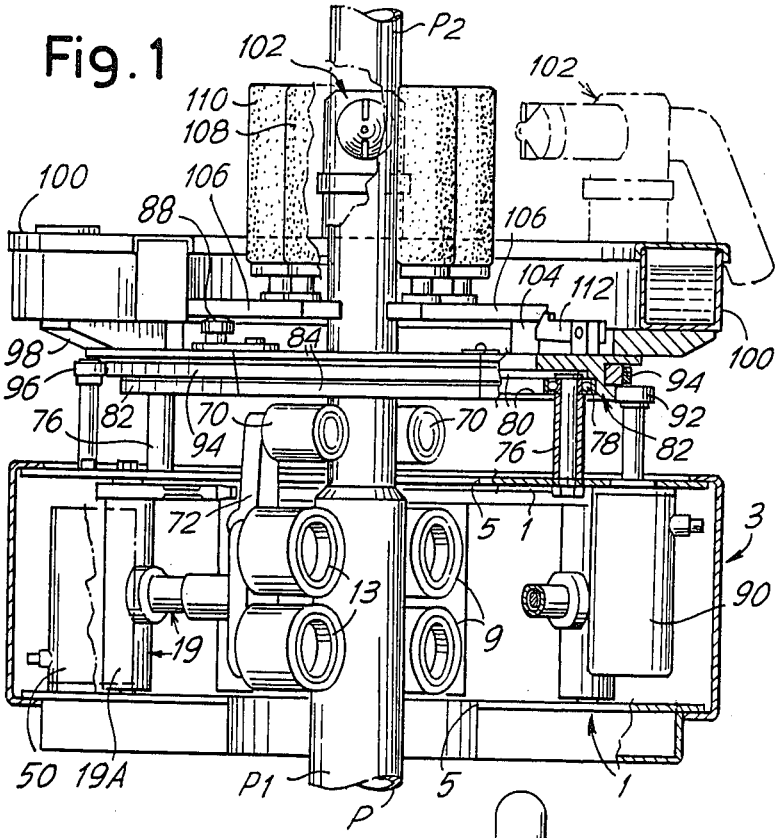
FIG. 1 is an elevational view, partly in section, showing an apparatus constructed in accordance with the invention.

In the accompanying drawings (see in particular FIG. 1), by P an installed pole is shown with which a painting operation and, brush cleaning or the like may to be performed. The pole may be cylindrical or conical and may also have tapers as is shown in FIG. 1 where the pole P is made up of two sections P1 and P2 which are step-wise jointed. The apparatus may be utilized for poles of different diameters.

Numeral 1 indicates a main structure of the apparatus, which makes up a casing 3, within which members of the driving rollers system are received for the vertical displacement along the pole. The casing 3 is shaped like an open ring having a wide opening 5 which projects radially from the central open space of the annular structure 3 up to the periphery of the same structure. This permits mounting of the casing sideways on the pole P, the moving rollers being kept wide apart, that is, moved away from each other. The driving rollers consist of four pairs of rollers 7, 9, 11 and 13. Each pair of rollers is mounted for the rotation on support arms 15, 17, 19 respectively for the pairs of rollers 7, 9 and 13 and on arm-like supports 21 for the pair of rollers 11. Each of said arm-like supports comprises a transmission which is for the rollers operation. The transmission housed in the arm-like support 19 (which is also the same as supports 15 and 17) will be now described, particular reference being made to FIG. 4. The support 19 has a mounting column 19A supported—through bearings 25 and 27—by an upper fixed pivot 29 and by a shaft 31, respectively, the shaft 31 being mounted on the column 19A through the bearing 27 and a bearing 33, that is also mounted on the structure 1 through a bearing 35 in order to project on same structure 1 and carry a chain wheel 37. The column 19 engages a tubular member 19B which develops at right angle to the column 19A and, thus, is horizontally disposed in use; on the tubular member 19B a sleeve or hub 19C is fitted which carries a box 19E on which pivots are mounted (like that indicated by 20) to support the two driving rollers of pair 13. Each box 19E is angularly orientable within limits owing to the coupling between 19B and 19C and/or owing to a rigid adjustment in the flange 19K on the column 19A, in order to adjust, in any case, the pair of rollers 13 to the inclination and/or the steps of the pole along which the apparatus is to slide. The shaft 31, through a bevel gear pair 39, operates a shaft 41 inside the member 19B, which shaft 41, through a gear drive 43, operates the rotation according to the same direction of the two driving rollers 13 of the considered pair. The arm-like supports 15 and 17 are similar to the arm 19, already described, the horizontal members (like 19B, 19C) being at the same level as 19. In the illustrated embodiment, the arm 21 is located at a lower level, being associated with a column 21A having inside a smaller shaft 31X for a transmission similar to the one described, but being differentiated in the gears 43X for the driving of rollers 11, while a further pair of gears 45X is provided between the shaft 31X and the chain wheel 37X analogous to wheel 37.

Figure 9:
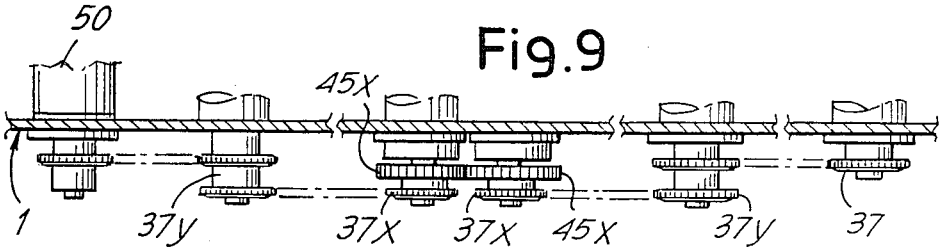
FIG. 9 shows a detail of a transmission mechanism for driving the inventive apparatus.

The chain wheels 37, 37X and equivalent, are all operated by a single motor 50 through chain transmissions which are shown in detail in FIG. 9, where there are also shown the chain wheels 37, 37X and the others indicated by 37Y which are provided in pairs in order to operate the motion transmission between one axis and the other of the arm columns. The disposition of the transmission between the motor 50 and the moving rollers of pairs 7, 9, 11 and 13 is, however, such as to ensure a simultaneous rotation in the same direction of all the rollers, which rotation may be reversed by operating the motor 50 in reversed motion in order to obtain the lift and descent of the apparatus along the pole.

The arms 15, 17, 19 and 21 must be capable of being angularly displaced around the respective columns like those indicated by 19A and 21A, so that to draw near and move away the rollers respect to the pole axis (when the apparatus has already been mounted); the rollers 7, 9, 11 and 13 must be moved away as shown with dotted line in FIG. 3 in order to fit the apparatus on the pole whatever its diameter may be, and must be urged towards the pole axis and then the ones towards the others to engage with some pressure and some friction the pole wall at points more or less equidistant between them along each of the two contacting circumferences. In order to obtain this, the single columns, like the ones indicated by 19A and 21A, of arms 15, 21, 17 and 19 are kinematically matched between them in order to rotate each in opposite direction to those of the adjacent columns, and this is operated by pairs of sector gears 54, 56, 58, 60, 62, 64, being the sectors 56, 58 and, respectively, the sectors 60, 62 solid between them. The set of sectors 54 to 64 is operated starting from sector 54 by a pneumatically or fluid-operated piston-cylinder system, indicated by 66 and articulated at 68 to the casing 3 as well as to a radial arm of sector 54. The cylinder-piston system 66 when lengthening, causes the rollers 7 and 13 to open apart, and when getting shorter, forces the rollers against the pole whatever its diameter may be.

With the described arrangement, it is possible to place the structure 1, 3 close to the pole and move it away from it, while an effective displacement of the structure along the pole by the rollers may be obtained operating with a perfect matching to the profiles and cross-sections sizes of the poles. The matching to the pole profile is obtained, besides through the above mentioned angular adjustments of the arms along the axis of the driving shafts like that indicated by 41, also for the presence of stabilization rollers 70 carried by elastic arms 72 (FIGS. 1 and 4) which are engaged with the boxes like the box indicated by 19E in order to bring the rollers 70 spaced apart above the pairs of moving rollers 7, 9, 11, 13. These stabilization rollers 70, elastically supported, intervene to render regular the movement in case of relatively sudden changes of the pole profile, for example in presence of joining steps. A high stability of the apparatus is thus obtained during its displacements along the pole.

It should be appreciated that the apparatus may be mounted for displacements along even non-cylindrical poles, provided a relatively broad resting surface for the assembly of the eight moving rollers is obtained. The jack 66 provides an adjustable and uniform pressure of the rollers on the pole surface.

Figure 2:
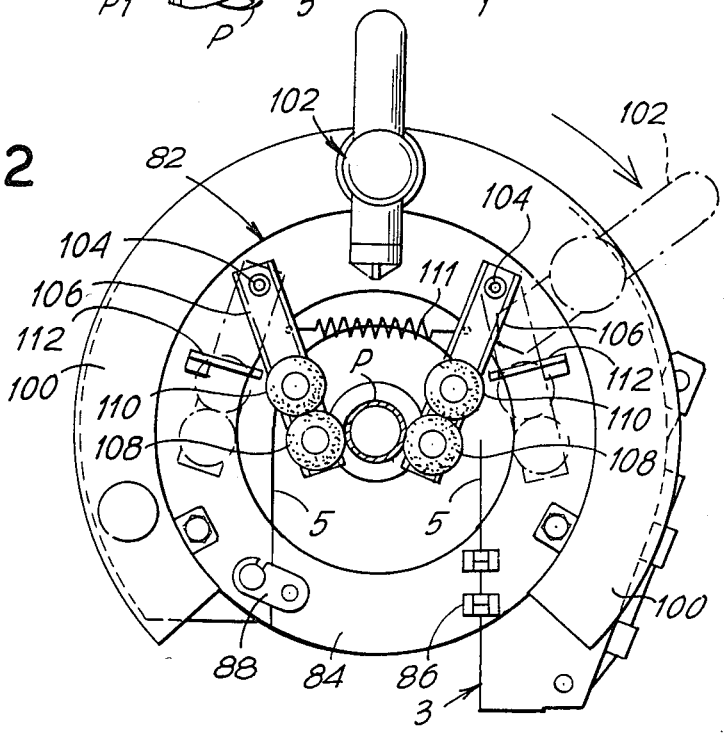
FIG. 2 is a top view of the apparatus of FIG. 1.
Figure 7:
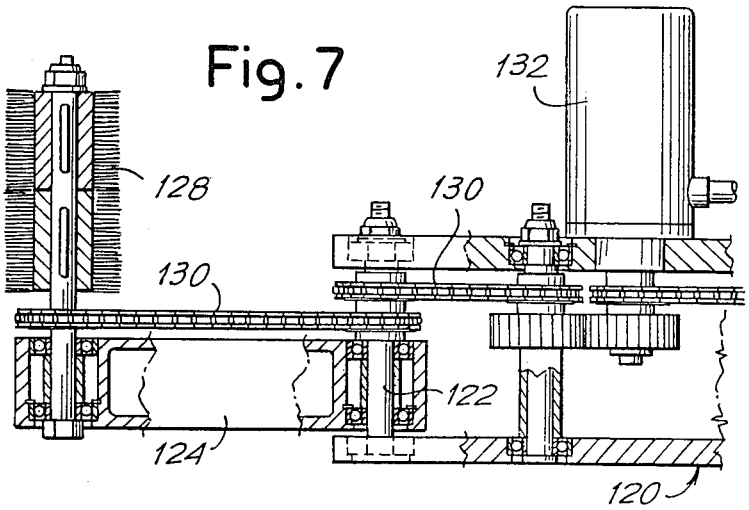
FIG. 7 shows a detail along line VII of FIG. 6.

The apparatus described herein-before in its parts which provide for its displacement along the pole, is designed for performing brush or equivalent cleanings of the pole and the painting of the same. In FIGS. 1 and 2 the apparatus is illustrated set up for painting. In FIGS. 6 and 7 and in the modified embodiment of FIG. 8, the apparatus is illustrated equipped for brush-operated cleaning.

The structure 1, 3 carries in its upper part, columns 76 which have, in their upper end, guide rollers 78 in the form of ball bearings or other, able to cooperate with a race 80 having an internal throat formed in a carrousel equipment 82. This equipment is made up of a ring with a part 84 articulated at 86 and which can be engaged with a latch 88 at the opposite part; in this way it is possible to complete the ring of the carrousel through the members 82 and 84 and, thus, to complete the race 80, and the ring can be opened to consent to place the apparatus close to the pole by previous alignment of the aperture created by the lifting of part 84 with the aperture 5; the continuity of the race is insured by the hinges 86 and the latch 88. A motor 90 on the structure 1, 3 operates a drive wheel 92 to give a motion—through friction or a toothing—to the carrousel 82, 84 which is supplied with a corresponding rolling race or a toothed crown for the driving wheel 92. Since, in some circumstances, it is necessary to feed electric power to the rotating equipment belonging to the carrousel 84, an annular strip for sliding contact, is further provided, being suitably isolated and able to cooperate at least with one sliding contact 96, of coal brush type or equivalent, carried by the structure 1, 3.

The equipment rotating around the pole axis (when the apparatus is placed close the pole) and made up of the carrousel 82, 84, in FIGS. 1 and 2, carries a support 98 having an open ring shape, supporting a paint reservoir 100 also developed as an open ring and as a small basin. On said reservoir, a spray gun unit 102 is mounted which may be directly operated by an electric motor or by compressed air suitably generated or supplied.

Directly on the carrousel 82, or on the support 98, two arms 106 are articulated at 104, symmetrically to the gun unit 102, each of which carries at the mobile end a pair of rollers 108 and 110 having vertical axes; these rollers have adsorbent surfaces. The two arms 106 are urged by a spring 111 the one towards the other in such a way that the rollers 108 will come in contact with the pole P whatever its diameter may be; the rollers 110 are in contact wtih the respective roller 108. Upon rotation of the carrousel 82, 84 the two rollers 108 roll on the pole surface and give motion to respective rollers 110. The two pairs of rollers 108 and 110, owing to their position respect to the gun unit 102 and owing to their height, make up an efficient, protective curtain for the paint ejected from the unit 102. By this arrangement, the paint which is not directly thrown on the pole is practically picked up by rollers 108 and 110 on which it is more or less marginally thrown, and these rollers transfer it on the pole to be painted. Besides assuring a substantial utilization of the paint without significant losses, the disposition of rollers 108, 110, permits also to obtain a regular spreading of the paint on the pole, since the action of ejection and spreading of the paint takes place while the carrousel 82, 84 of the rotating equipment, rotates during the lowering displacements of the apparatus along the pole. The preferred rotation and lowering speeds depends on the length in vertical direction of rollers 108 and 110, i.e., so as to ensure a repeated action of rollers 108 at each level of the pole. The risk of the paint dripping or leaking along the pole is also avoided by the repeated action of rollers 108.

To make the apparatus reach the top of the pole in order to begin the painting from the upper part, before the first moving of the apparatus upwards, the arms 106 are elastically opened wide apart respect each other up to the position shown with dotted line in FIG. 2, at which position these arms are retained by retaining hooks 112. The retaining action of said hooks 112 is neutralized, through suitable remote control, the moment the rotation of the motor 50 is reversed to start the lowering of the apparatus while simultaneously giving the start for rotation of carrousel 82, 84 by the actuation of motor 90 and by starting the spout or ejection of the gun. At the beginning of the movement of equipment 82, 84 of the carrousel, the hooks 112 move facing at least a suitable cam profile fixed on the structure 1, 3 and are operated by this profile to release arms 106 and thus to cause the matching and the rolling over of rollers 108 against the pole.

It should be appreciated that the level of gun 102 and of rollers 108, 110 is above the level of the pairs of rollers 7 to 13, which permits to reach and paint even the upper end of the pole since the apparatus is supported on the pole at a certain distance from said end.

FIGS. 6 and 7 show how the apparatus can be equipped with brush means having their axis parallel to the pole, for the cleaning of its surface. On the carrousel 82, 84 a structure 120 is applied—in place of the painting system—to which structure two arms 124 are articulated at 122, being urged the one towards the other by a spring 126 likewise as the arms 106 and being capable to be retained by the retaining hooks 112 or equivalent in the same way as the arms 106. Each arm 124 carries at the mobile end, a rotating brush 128, which is made to rotate by a chain transmission 130 which takes the motion from a motor 132. The brushes rotate relative to the pole in order to work the one in opposite direction to the other on the same pole surface; the brushes have such a height as to effect a prolonged cleaning action on the pole, which action can be developed either during the lift or the descent of the apparatus along the pole.

Figure 8:
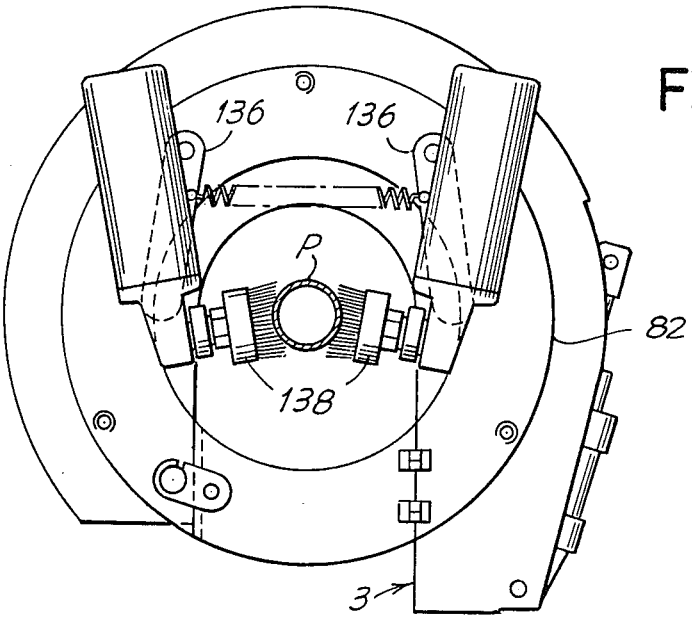
FIG. 8 shows a detail of an alternate embodiment of the apparatus of FIG. 1.

In FIG. 8 a further embodiment is shown in which the arms 136—similar to those indicated by 124—carry brushes 138 mounted to rotate around the pole, each brush being advantageously constructed to rotate independently of the other.

After the brushing operations the apparatus or the operative unit can be replaced, and thus the painting can be performed by sending the apparatus to the upper end of the pole and beginning the painting from top downwards.

The continuity of the rolling race with the rotating equipment, formed by parts 82, 84, is interrupted by releasing the latch 88, when the apparatus is to be removed by the pole on which it has been applied.

Although the invention has been illustrated in detail above in connection with several embodiments, various modifications will be readily apparent to those of ordinary skill in the art. Such modifications are within the spirit and scope of the present invention which is limited and defined only by the appended claims.

What is claimed is:

1. An apparatus for maintaining pole structure comprising in combination a carriage constructed to be upwardly and downwardly movable along the axis of a pole, a carousel rotatably secured to said carriage mounted to revolve around said pole as said carriage moves therealong, at least a pair of support arms located on said carousel biased towards said pole and at least a pair of brushes mounted on said support arms such that said brushes engage said pole.

2. The apparatus according to claim 1, wherein said pair of brushes comprises almost cylindrical brushes, the rotation axis thereof being substantially parallel to the pole axis.

3. The apparatus according to claim 1, wherein said pair of brushes mounted on said support arms comprise brushes having frontal bristles, such that said brushes rotate around the radial axis of said engaged pole.

4. The apparatus according to claim 1, wherein said brushes are carried by arms urged towards the pole by elastic means, and further comprising means able to keep said arms spaced apart in order to permit the lifting and moving of the carriage.

* * * * *